US007775358B1

(12) United States Patent
Huang

(10) Patent No.: US 7,775,358 B1
(45) Date of Patent: Aug. 17, 2010

(54) TOOL BOX WITH TILTING AND SLIDING COVER

(76) Inventor: Jui-Min Huang, No. 680, Dadun 12nd St., Nantun District, Taichung City (TW)

( * ) Notice: Subject to any disclaimer, the term of this patent is extended or adjusted under 35 U.S.C. 154(b) by 0 days.

(21) Appl. No.: 12/488,576

(22) Filed: Jun. 21, 2009

(51) Int. Cl.
*B65D 85/20* (2006.01)
*B65D 5/50* (2006.01)

(52) U.S. Cl. ..... 206/379; 206/372; 206/349; 220/4.22

(58) Field of Classification Search ..... 206/372, 206/349, 377–379, 370, 373, 375, 458, 749, 206/759; 220/4.21–4.24, 4.26, 4.28, 4.32–4.34, 220/4.01, 4.03, 503, 507; D3/294, 905
See application file for complete search history.

(56) References Cited

U.S. PATENT DOCUMENTS 6,415,923 B1 * 7/2002 Chen ..... 206/379
6,915,900 B2 * 7/2005 Chen ..... 206/350
2003/0006155 A1 * 1/2003 Ching-Hui ..... 206/373

* cited by examiner

*Primary Examiner*—Ehud Gartenberg
*Assistant Examiner*—Ernesto A Grano
(74) *Attorney, Agent, or Firm*—Egbert Law Offices PLLC

(57) ABSTRACT

The present invention provides a tool box with tilting and sliding cover, including a box body, which contains a back surface, two lateral surfaces and an accommodation space. There is a track, set onto a lateral surface of the box body, and a tilting and sliding cover, used to cover the accommodation space of the box body. A mating portion is arranged onto one side of the tilting and sliding cover. A moveable connector is arranged between the track and the mating portion of the tilting and sliding cover. The moveable connector contains a rotary sliding seat and a cover coupling portion. The rotary sliding seat is fixed securely into the track in a rotary and slidable state, while the cover coupling portion is coupled with the mating portion set for the tilting and sliding cover.

7 Claims, 8 Drawing Sheets

TOOL BOX WITH TILTING AND SLIDING COVER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a tool box, and more particularly to an innovative tool box with a tilting and sliding cover.

2. Description of Related Art

Including Information Disclosed Under 37 CFR 1.97 and 37 CFR 1.98.

The present invention refers to an improved tool box with tilting and sliding cover.

When the tilting cover of said tool box is opened to an angle, if the opening state of the cover must be maintained, the overall area of the tool box will be excessively bigger due to the same area of the cover and the tool box. In such a case, the tool box on the ground has little effect on the users, otherwise, leads to inconvenience of operation, higher burden and lower flexibility if it is carried by the users.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

There is enhanced efficacy of the present invention.

Based on the unique present invention, the tool box with a tilting and sliding cover is mainly comprised of a box body, track, tilting and sliding cover and moveable connector. The rotary sliding seat can rotate and slide securely along the track, and the tilting and sliding cover of the tool box can be retracted on the back surface of the box body, thus reducing markedly the space of the tool box with better convenience and applicability.

There are improvements brought about by this invention.

Based on the structure of the tilting and sliding cover provided with a recessed space, when the tilting and sliding cover is tilted 180° and shifted correspondingly to the back surface of the box body, the recessed space can be used for accommodating spare parts and articles, thus improving the functionality of the tilting and sliding cover and tool box with higher applicability.

DETAILED DESCRIPTION OF THE INVENTION

Figure 1:
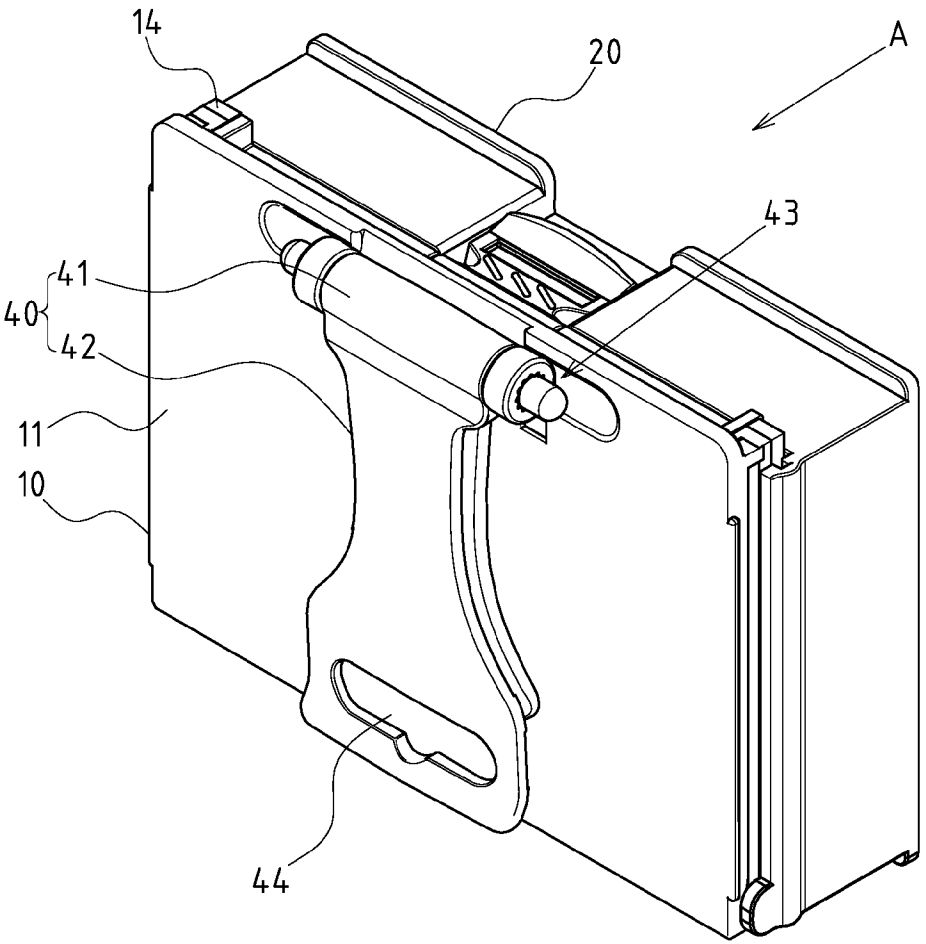
FIG. 1 shows an assembled perspective view of the preferred embodiment of the present invention.
Figure 2:
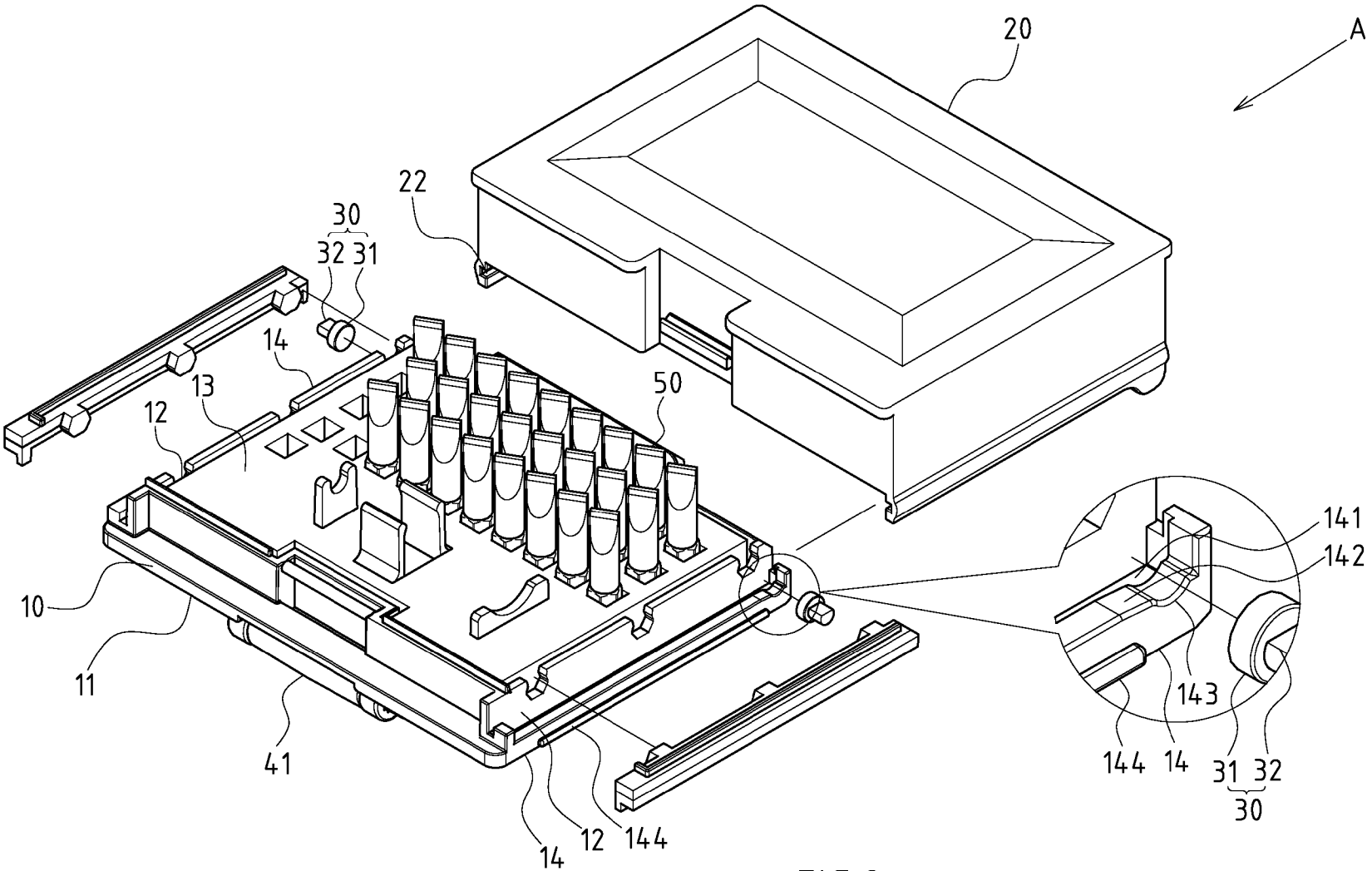
FIG. 2 shows an exploded perspective view of the preferred embodiment of the present invention.
Figure 3:
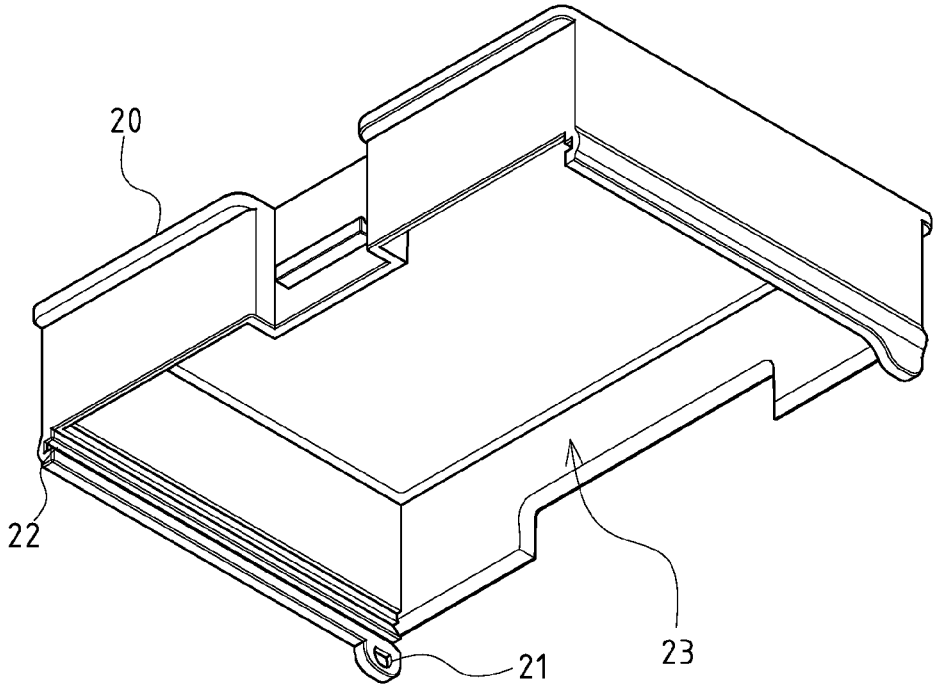
FIG. 3 shows a perspective view of another angle of the tilting and sliding cover of the present invention.
Figure 4:
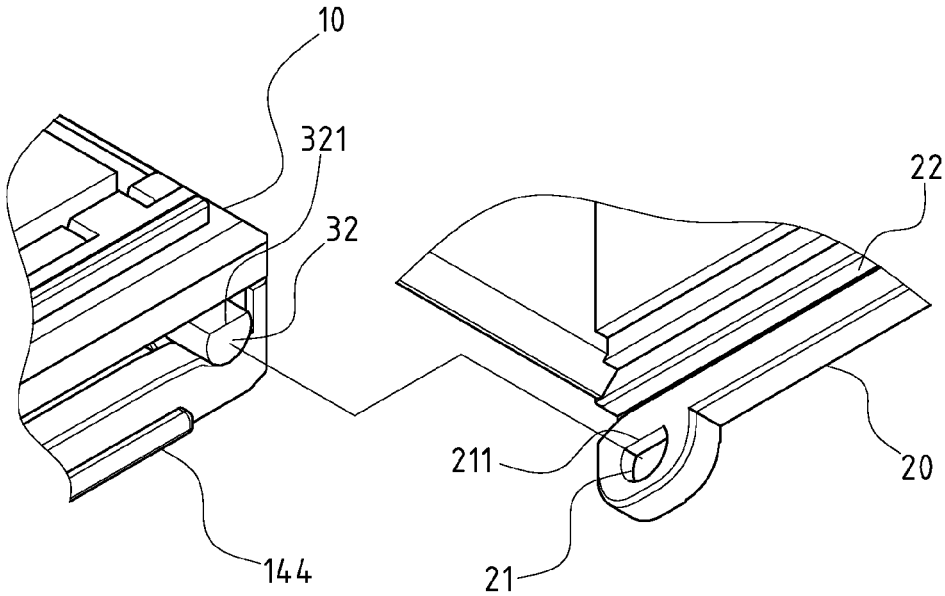
FIG. 4 shows a partially enlarged perspective view of the preferred embodiment of the present invention.
Figure 6:
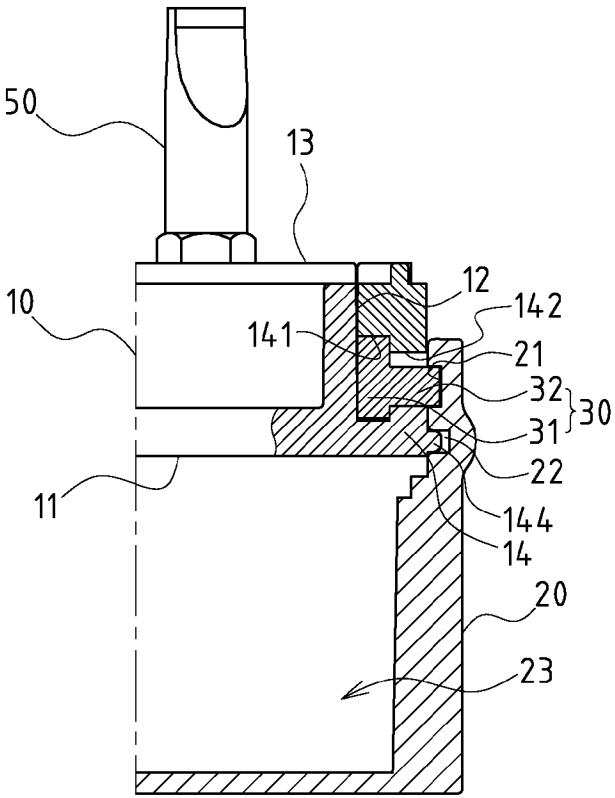
FIG. 6 shows a sectional view of the present invention that the tilting and sliding cover is titled 180°.

FIGS. 1-6 depict preferred embodiments of a tool box of the present invention with a tilting and sliding cover. The embodiments are provided for only explanatory objectives for patent claims.

The tool box A comprises a box body 10, which contains a back surface 11, two lateral surfaces 12 and an accommodation space 13.

There is at least a track 14, set onto at least a lateral surface 12 of the box body 10.

A tilting and sliding cover 20 is used to cover the accommodation space 13 of the box body 10. A mating portion 21 is arranged at interval onto one side of the tilting and sliding cover 20.

Two moveable connectors 30 are arranged separately between two tracks 14 and two mating portions 21 set for the tilting and sliding cover 20. A moveable connector 30 contains a rotary sliding seat 31 and a cover coupling portion 32. The rotary sliding seat 31 is fixed securely into the track 14 in a rotary and slidable state. The cover coupling portion 32 is coupled with the mating portion 21 set for the tilting and sliding cover 20. With this invention, the tilting and sliding cover 20 can be tilted 180° and shifted correspondingly to the back surface 11 of the box body 10 by taking the moveable connector 30 as a pivot, and then retracted to the back surface 11 of the box body 10 along the track 14.

Of which, two tracks 14 are of inwards curved profile defining an inward guide slot 141 and a reducing through-hole 142. The rotary sliding seat 31 of the moveable connector 30 is embedded into the inward guide slot 141 in a slidable state. The cover coupling portion 32 of the moveable connector 30 is protruded from the reducing through-hole 142. The cover coupling portion 32 is mated with the mating portion 21 of the tilting and sliding cover 20 by the column and round hole, and the cover coupling portion 32 and mating portion 21 are provided with outward flange 321 and inward flange 211 that permit interlocking for directional positioning. At one end of the track 14, a recessed edge 143 is provided for partial embedding of the column of the cover coupling portion 32 and locating of the moveable connector 30. Such a locating state can be removed when the cover coupling portion 32 is rotated to make the alignment of the outward flange 321 with the recessed edge 143.

At two lateral surfaces 12 of the box body 10, an auxiliary track 144 is arranged protrusively at interval on the track 14, so that groove 22 is arranged on two inner walls correspondingly to the tilting and sliding cover 20. The auxiliary track 144 and groove 22 are mated and interlocked when the tilting and sliding cover 20 is tilted 180° and shifted towards the back surface 11 of the box body 10, thus enabling stable guiding of the shift of the tilting and sliding cover 20.

A belt clip 40 is assembled on the back surface 11 of the box body 10 for multi-angle adjustment and positioning. The belt clip 40 contains a mating portion 41 and a belt clamping portion 42, of which the mating portion 41 is fixed onto the back surface 11 of the box body 10 in a swinging state, and also provided with a multi-angle adjusting and locating member 43, enabling locating of the swinging belt clip 40.

Figure 11:
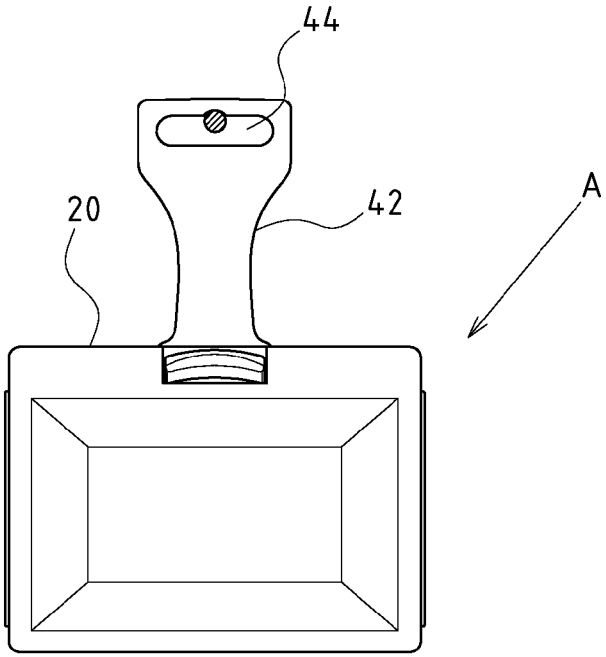
FIG. 11 shows an elevation view of an application of the lifting hole of the present invention.

Referring to FIG. 11, a lifting hole 44 is opened at the end of the belt clamping portion 42 of the belt clip 40.

Of which, the tilting and sliding cover 20 is provided with a recessed space 23. When the tilting and sliding cover 20 is tilted 180° and shifted correspondingly to the back surface 11 of the box body 10, the recessed space 23 can be used for accommodating spare parts and articles.

Figure 5:
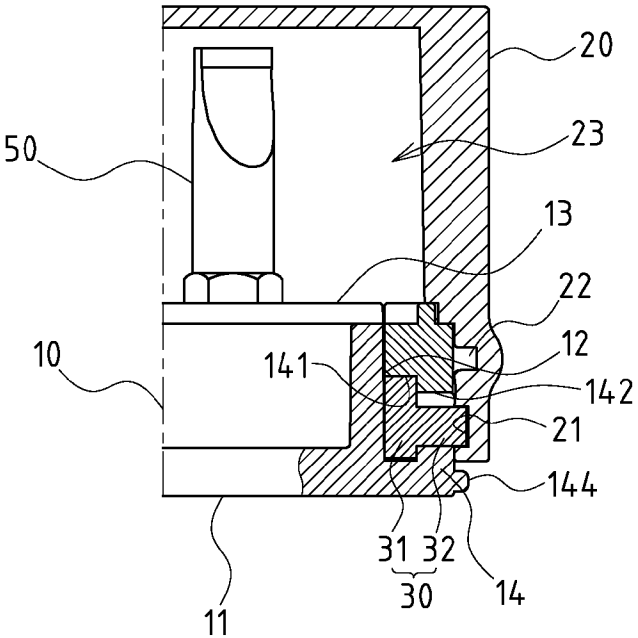
FIG. 5 shows a sectional view of the present invention that the tilting and sliding cover is in a sealed state.
Figure 7:
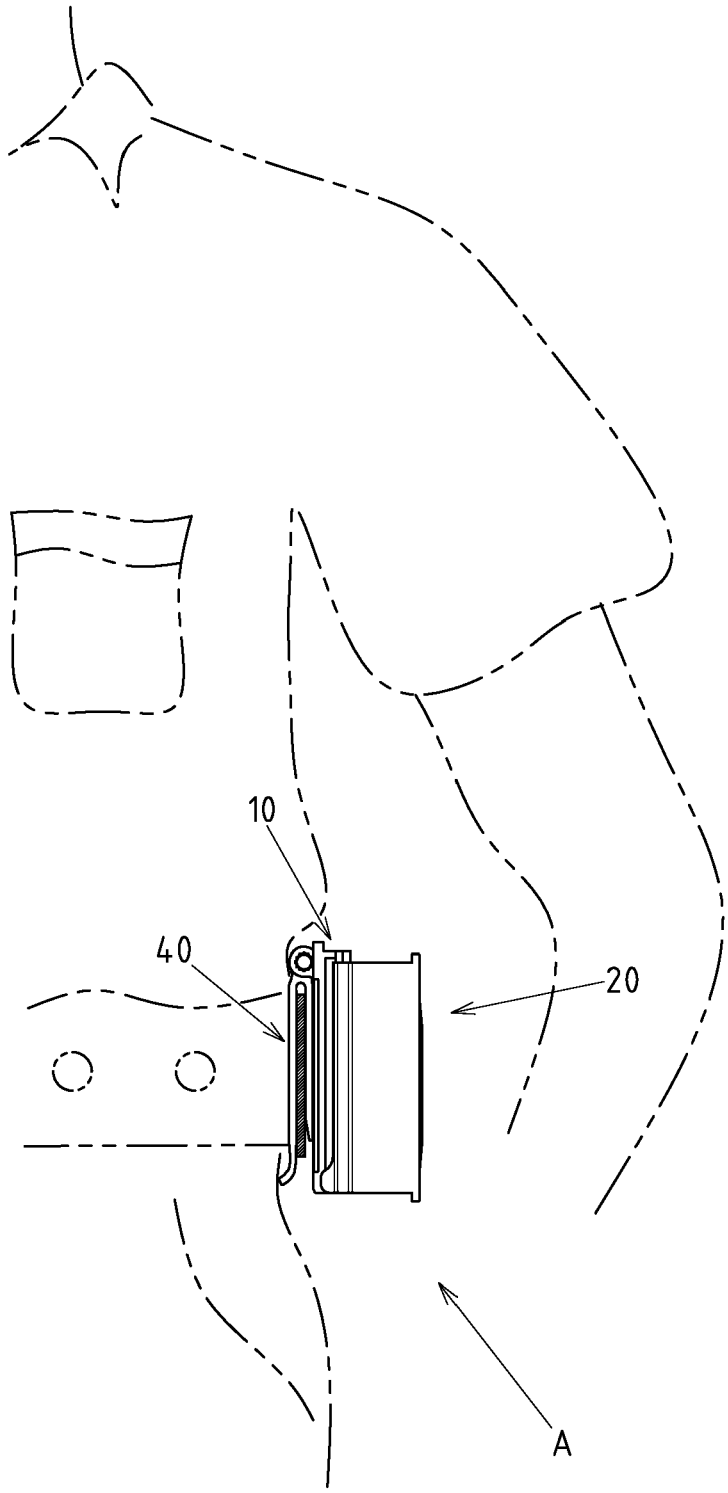
FIG. 7 shows a schematic view of an application of the preferred embodiment of the present invention.
Figure 8:
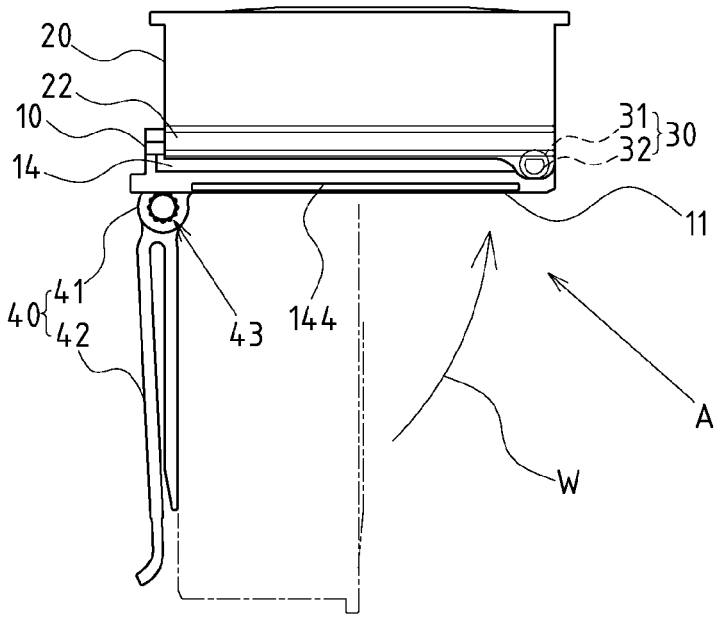
FIG. 8 shows an elevation view of the actuation of the preferred embodiment of the present invention.
Figure 9:
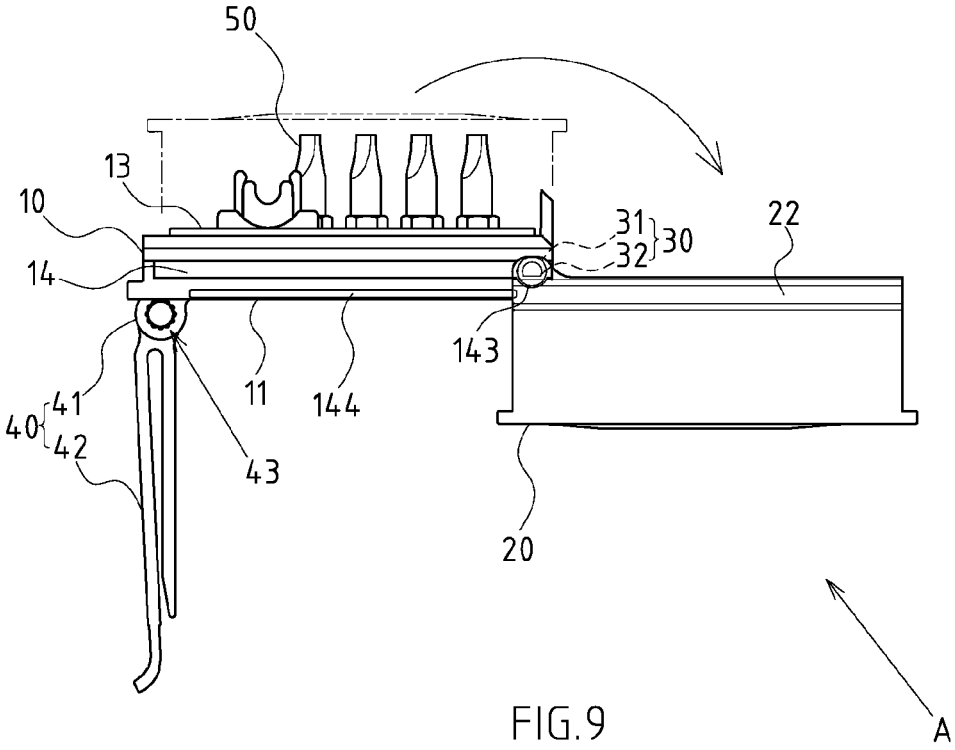
FIG. 9 shows an elevation view of a second actuation of the preferred embodiment of the present invention.
Figure 10:
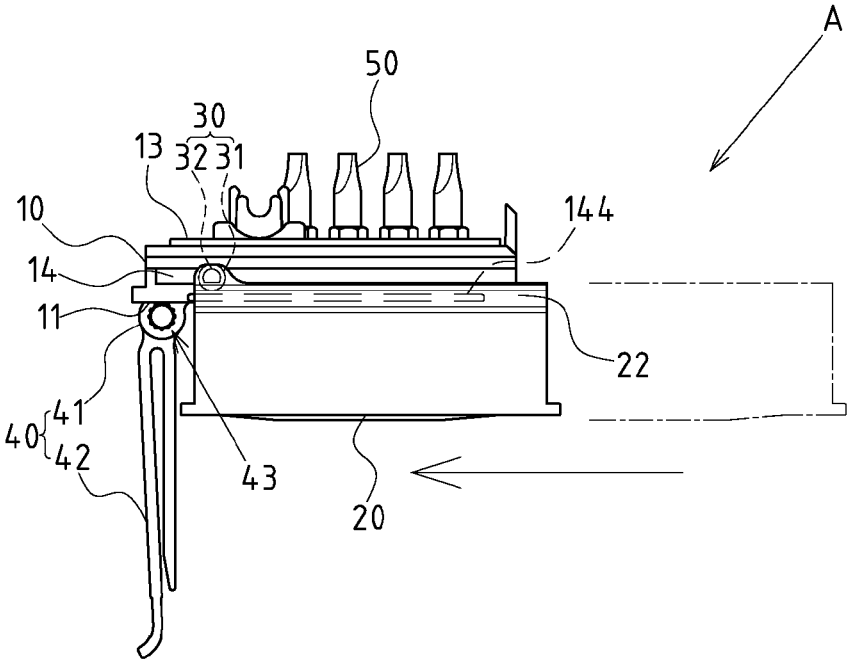
FIG. 10 shows an elevation view of a third actuation of the preferred embodiment of the present invention.

Based on above-specified structures, the present invention is operated as follows:

Referring first to FIG. 7, the user can fasten securely the tool box A on his/her waist by the belt clamping portion 42 of the belt clip 40, and where necessary, adjust the tool box A to a preset angle and position it using the multi-angle adjusting and locating member 43 (disclosed by W in FIG. 8) (in conjunction with FIG. 5). In such a case, the cover coupling portion 32 of the tool box A is interlocked with the outward flange 321 and inward flange 211 of the mating portion 21 for directional positioning purpose. Moreover, the cover coupling portion 32 is partially embedded into the recessed edge 143, disabling the sliding of the moveable connector 30. When the user is intended to use the tool 50 in the accommodation space 13 of the box body 10, the tilting and sliding cover 20 must be tilted 180° by taking the moveable connector 30 as a pivot, thus opening the tilting and sliding cover 20 to expose the tool 50 and make it accessible, as shown in FIG. 9. Furthermore, the recessed space 23 can be opened upwards for accommodating spare parts and articles. The tilting and sliding cover 20 can be retracted correspondingly to the back surface 11 of the box body 10. Referring to FIG. 10, the cover coupling portion 32 is aligned with the outward flange 321 and inward flange 211 of the mating portion 21, so the rotary sliding seat 31 can slide securely along the track 14, and then be retracted onto the back surface 11 of the box body 10 (in conjunction with FIG. 6).

Figure 12:
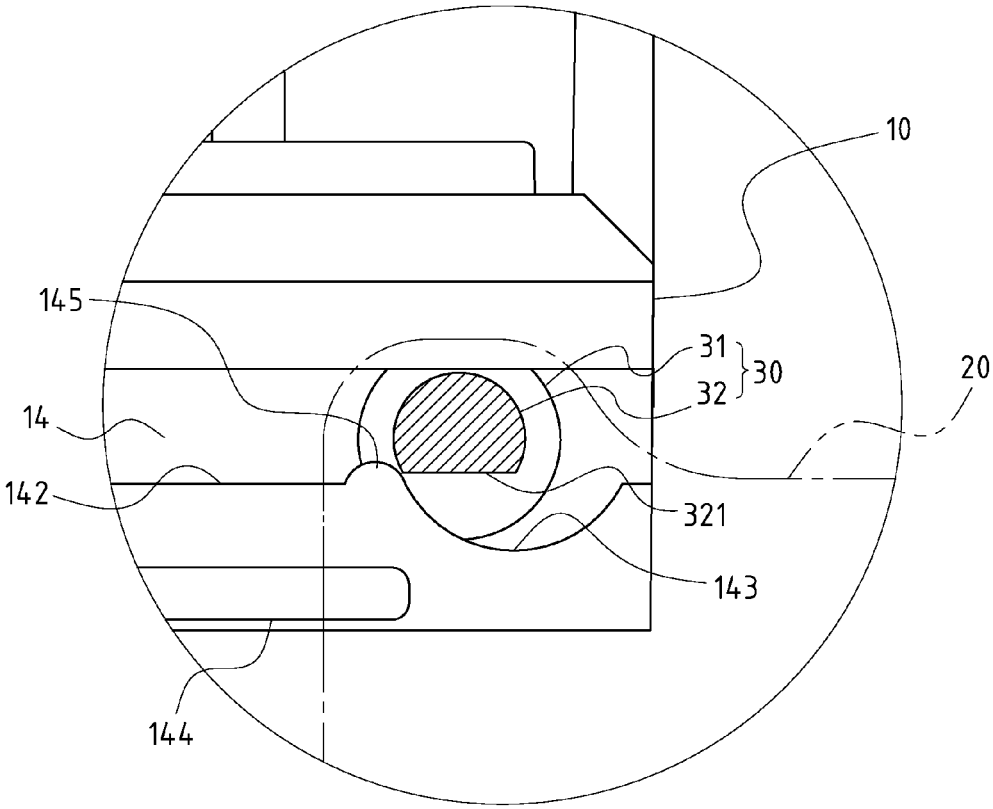
FIG. 12 shows sectional view of an application of the present invention, wherein the track reducing through-hole is provided with a convex snapping flange.

Referring also to FIG. 12, a convex snapping flange 145 is arranged on the reducing through-hole 142 of the track 14 nearby the recessed edge 143, and used to lock the cover coupling portion 32 of the moveable connector 30 so as to prevent any inward sliding of the tilting and sliding cover 20 or the rotating smoothness of the cover coupling portion 32. Since the cover coupling portion 32 is only suitable for rotation correspondingly to the recessed edge 143, any forced rotation in other regions of the track 14 may lead to jamming or damage.

I claim:

1. A tool box with a tilting and sliding cover, said tool box comprising:

a box body, having a back surface, two lateral surfaces and an accommodation space;

a track, set onto each of said lateral surfaces of the box body;

a tilting and sliding cover, covering the accommodation space of the box body, and having two mating portions arranged at opposite sides of the tilting and sliding cover; and a moveable connector, arranged between each said track and each said mating portion of the tilting and sliding cover, said moveable connector having a rotary sliding seat and a cover coupling portion, said rotary sliding seat being fixed securely into the track in a rotary and slidable state, said cover coupling portion being coupled with each said mating portion set for the tilting and sliding cover, the tilting and sliding cover being tilted 180° and shifted correspondingly to the back surface of the box body by taking the moveable connectors as a pivot, and then retracted to the back surface of the box body along the tracks.

2. The tool box defined in claim 1, wherein each said track has an inwards curved profile defining an inward guide slot and a reducing through-hole, said rotary sliding seat of the moveable connector embedded into the inward guide slot in a slidable state, said cover coupling portion of the moveable connector protruded from the reducing through-hole, said cover coupling portion is mated with the mating portion of the tilting and sliding cover by the column and round hole, and the cover coupling portion and mating portion being provided with outward and inward flanges that permit interlocking for directional positioning, wherein at one end of each said track, a recessed edge is provided for partial embedding of the column of the cover coupling portion and locating of the moveable connector; such a locating state can be removed when the cover coupling portion is rotated to make the alignment of the outward flange with the recessed edge.

3. The tool box defined in claim 2, wherein a convex snapping flange is arranged on the reducing through-hole of each said track nearby the recessed edge, and used to lock the cover coupling portion of the moveable connector.

4. The tool box defined in claim 1, wherein an auxiliary track is arranged protrusively at intervals on each said track at the lateral surface of the box body, a groove being arranged on the inner wall correspondingly to the tilting and sliding cover, an auxiliary track and groove mated and interlocked when the tilting and sliding cover is tilted 180° and shifted towards the back surface of the box body, thus enabling stable guiding of the shift of the tilting and sliding cover.

5. The tool box defined in claim 1, further comprising:

a belt clip assembled on the back surface of the box body for multi-angle adjustment and positioning, said belt clip having a mating portion and a belt clamping portion, said belt clip mating portion being fixed onto the back surface of the box body in a swinging state, and also provided with a multi-angle adjusting and locating member, enabling locating of the swinging belt clip.

6. The tool box defined in claim 5, wherein a lifting hole is opened at the end of the belt clamping portion of the belt clip.

7. The tool box defined in claim 1, wherein the tilting and sliding cover has a recessed space, when the tilting and sliding cover is tilted 180° and shifted correspondingly to the back surface of the box body, the recessed space being used for accommodating spare parts and articles.

* * * * *